US006786801B2

(12) United States Patent
Mann

(10) Patent No.: US 6,786,801 B2
(45) Date of Patent: Sep. 7, 2004

(54) METHOD FOR GASKET REMOVAL

(75) Inventor: Lawrence J. Mann, Lake Elmo, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 434 days.

(21) Appl. No.: 10/014,221

(22) Filed: Dec. 11, 2001

(65) Prior Publication Data

US 2003/0114078 A1 Jun. 19, 2003

(51) Int. Cl.[7] ..... B24B 1/00

(52) U.S. Cl. ..... 451/28; 451/534; 51/298

(58) Field of Search ..... 451/356, 533, 451/534, 539, 28; 51/295, 298

(56) References Cited

U.S. PATENT DOCUMENTS

| | | | | |
|---|---|---|---|---|
| 3,382,058 | A | | 5/1968 | Wise et al. |
| 5,190,620 | A | | 3/1993 | Winter |
| 5,269,874 | A | | 12/1993 | Winter |
| 5,482,756 | A | | 1/1996 | Berger et al. |
| 5,679,067 | A | * | 10/1997 | Johnson et al. ..... 451/527 |
| 5,879,504 | A | | 3/1999 | Winter |
| 5,919,549 | A | | 7/1999 | Van et al. |
| 5,928,070 | A | | 7/1999 | Lux |
| 6,126,533 | A | | 10/2000 | Johnson et al. |
| 6,136,143 | A | | 10/2000 | Winter et al. |
| 2002/0014040 | A1 | | 2/2002 | Vincent |

FOREIGN PATENT DOCUMENTS

| | | |
|---|---|---|
| WO | WO 98/53956 | 12/1998 |
| WO | WO 00/41850 | 7/2000 |

OTHER PUBLICATIONS

"Service Bulletin", General Motors Corporation, Bulletin No.: 87–61–24, Apr. 1998, 1 page.

Copending U.S. patent application entitled "Cleaning Articles And Method Of Making", filed Apr. 12, 2001, Lawrence J. Mann et al., having U.S. Ser. No. 09/833942.

Japanese Patent Application entitled "Abrasive Pad", filed Oct. 1, 1985, Susan M. Butzer, having Japanese Application No. 219021/85 (Japanese Publication No. JP 94024706).

Dialog (R) File 350: Derwent WPIX, (c) 2001 Derwent Info Ltd. All rts. Reserv., Abstract for JP 1221435 A, Patent Assignee: Hitachi Chem Co. Ltd. (HITB).

Gasketing Sealpro, Inc. Internet Printout on Nov. 13, 2001 for web address "http://www.ultranet.com/~sealpro/gasketing.htm", "Dynapro GASKET"; "Copaltite"; "TFE Tape"; "TFE Paste"; "TFE Gasket Rope"; "TFE Valve Stem Packing"; "Graphite Tape"; and "Gasket Remover", 9 pages.

Taylor Automotive Internet Printout on Nov. 13, 2001 for web address "http://www.nbmc.com/taylor/t–7703.html", "Taylor Automotive, Construction and Industrial Pneumatic Air Tool T–7703", 1 page.

Standard Abrasives, Motor Sports Division Internet Printout on Nov. 13, 2001 for web address "htp://www.sri–supplies.com/standard_abrasives.htm", "Standard Abrasives—cartridge rolls, surface conditioning, cross buffs, porting kits", 4 pages.

Tools–Plus.com Internet Printout on Nov. 13, 2001 for web address "http://store.yahoo.com/toolsplus/lis51000.html", "TOOLS–PLUS discount woodworking, power, hand tool salesLISLE AUTO TOOLS:G/ . . . ", 2 pages.

"Service Bulletin", General Motors Corporation, Bulletin No.: 00–06–01–012, May 2000, 1 page.

* cited by examiner

*Primary Examiner*—Robert A. Rose
(74) *Attorney, Agent, or Firm*—Gregory D. Allen

(57) ABSTRACT

Method for removing gasket material from a surface using nonwoven, three dimensional fibrous web articles employ phenolic particles.

29 Claims, 1 Drawing Sheet

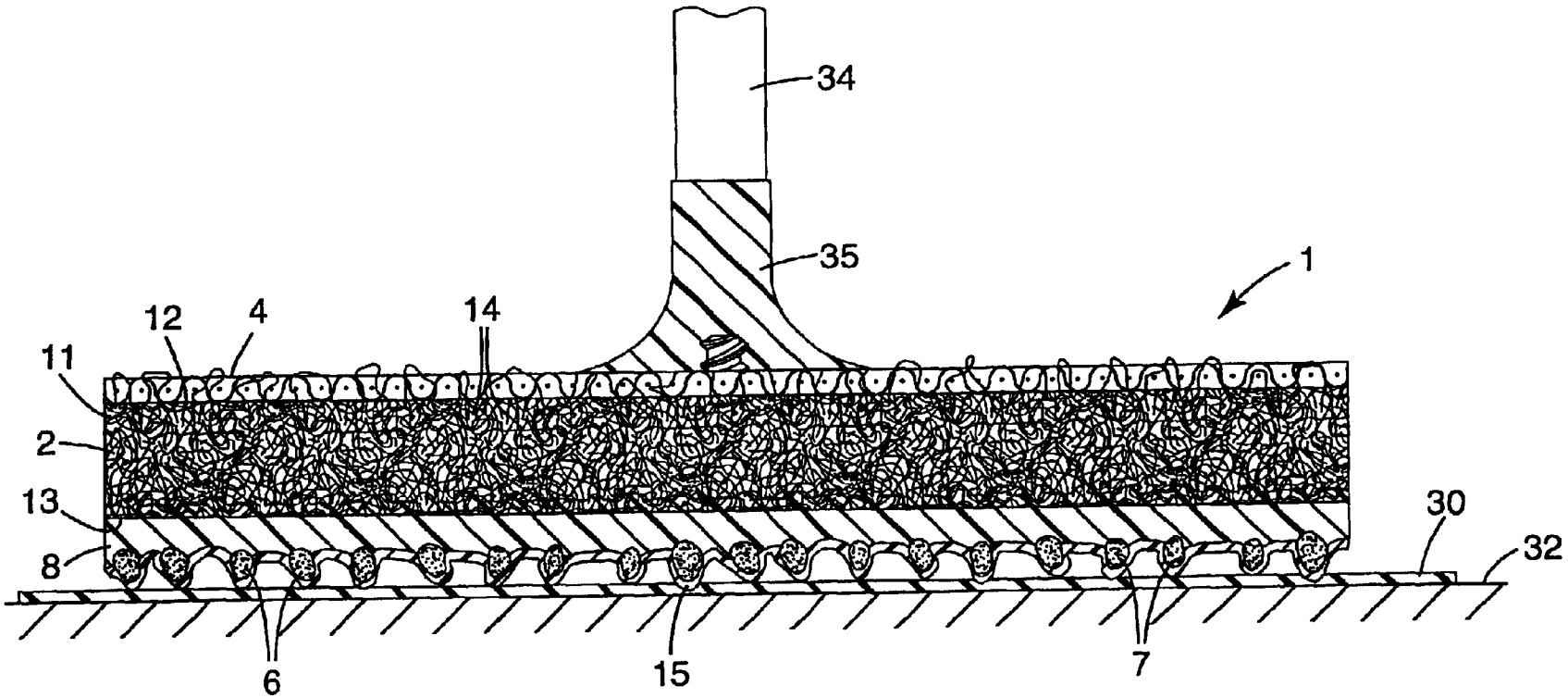
34
35
1
14
4
12
11
2
13
8
6
15
7
30
32

METHOD FOR GASKET REMOVAL

FIELD OF INVENTION

The present invention relates to the use of nonwoven, three dimensional fibrous web articles that employ phenolic particles to remove gasket material from a surface.

BACKGROUND

Gaskets are employed in a variety of mechanical applications (e.g., assembling the components of internal combustion engines) to effect a seal between two mating surfaces joined together by fasteners. Gasketing materials are generally softer and more compliant than the surfaces of the materials that they are sealing together. This compliance can aid in accommodating irregularities in the surfaces being mated, facilitating, for example, uniform fastener tension. In some applications, gaskets may be adhered with an adhesive to one or all mating surfaces. Even in the absence of an adhesive, however, sustained heat and pressure may cause the gasket material to autogenously adhere to one or more of the mating surfaces.

During the course of requisite maintenance and repair operations, it is frequently required to separate surfaces mated with a gasket(s). During the process of separating the surfaces, the gasket is almost always damaged so that re-use is prohibited. Further, residual gasket material frequently remains on one or more of the formerly mated surfaces. To reuse parts having residual gasket material thereon, it is necessary to remove the residual gasket material without damaging the mating surface. The presence of residual gasket material, and/or damage to a mating surface may adversely effect the quality of the seal between mated surfaces.

A number of methods for removing residual gasket material from mating surfaces are known in the art. For example, scrapers have been used to remove such residuals, but even when automated, their use is arduous and may cause inadvertent damage to the mating surfaces, especially if the scraper blades are made of metal. Solvents or other chemical compounds have been also been employed to remove residual gasket material. While chemicals have been effective for such purpose, there can be problems relative to disposal of contaminated detritus and introduction of volatiles into the environment.

Manual or automated employment of abrasive articles, especially those comprising lofty, nonwoven substrates adhered by resinous binder and coated with abrasive particles, have offered improved productivity for removing gasket material. Such articles typically do not damage the surface of the mating surface being cleaned, although when aggressively used with powered tools and/or under high contact pressures mating surface(s) can be damaged. Further, portions of the relatively hard abrasive particles typically dislodge from the abrasive article during use, and may lead to undesirable contamination of the mating and/or other neighboring surfaces.

There is a need for quick removal of residual gasket materials, without damaging the underlying surface (i.e., significantly adversely altering the mating surfaces), without the liberation of hard particles, and with no disposal or environmental complications.

SUMMARY OF THE INVENTION

The present invention provides methods for removing gasket material from a substrate (e.g., aluminum, cast iron, and alloys thereof), using an abrasive article (e.g., sheets, discs, and endless belts) comprising:

a scrim having a first major surface;

a nonwoven, three dimensional fibrous web having first and second major surfaces, wherein the first major surface of the fibrous web is needle tacked to the first major surface of the scrim; and an abrasive layer having work surface secured to the second major surface of the fibrous web, the abrasive layer comprised of binder and a plurality of phenolic particles, wherein the phenolic particles at the work surface are free of abrasive particles (i.e., particles having a mohs hardness of greater than 7) larger than 6 micrometers. Preferably, at least a portion (more preferably, at least a majority, even more preferably at least 60, 70, 75, 80, 90, 95, or even 100 percent by weight) of the phenolic particles are in the range from 150 micrometers to 2400 micrometers (more preferably, 400 micrometers to 850 micrometers, or even 150 micrometers to 1000 micrometers) in size. Optionally, at least a portion of the phenolic particles comprise filler. Preferably, all the phenolic particles are free of abrasive particles larger than 6 micrometers. Typically, the first major surface of the scrim is substantially co-extensive with the first major of the fibrous web.

In one embodiment, the present invention provides a method of removing gasket material from a substrate, the method comprising:

providing an abrasive article described herein having a work surface;

frictionally engaging at least a portion of the work surface of the abrasive article with the gasket material to be removed; and inducing relative motion between the abrasive article and the gasket material to be removed to remove at least a portion of the gasket material.

In another embodiment, the present invention provides a method of removing gasket material from a substrate, the method comprising:

providing power driven (e.g., electric motor driven or air driven) abrasive device comprising a rotatable shaft having an abrasive disc described herein having a work surface attached thereto; and energizing the power driven abrasive device such that the rotatable shaft rotates; and frictionally engaging at least a portion of the work surface of the rotating abrasive disc with the gasket material to be removed such that at least a portion of the gasket material is removed.

Preferably, the gasket material is removed from a substrate surface without changing the surface roughness of the substrate $\Delta R_a$ by not more than 9 microinches (0.23 micrometer), more preferably, not more than 6 microinches (0.15 micrometer).

BRIEF DESCRIPTION OF THE DRAWING

The FIGURE is a schematic side view in elevation of an exemplary assembly for removing gasket material from a substrate surface.

DETAILED DESCRIPTION

Referring to the FIGURE abrasive article 1 for removing gasket material 30 from substrate surface 32 comprises nonwoven, three dimensional fibrous web 2 with first major surface 11 of reinforcing scrim 4 needletacked to first major surface 12 of nonwoven web 2, and a plurality of phenolic particles 6 bonded by binder 8 to second major surface 13 of nonwoven web 2. Nonwoven web 2 has thickness 20. Optionally, phenolic particles 6 include filler 7. Nonwoven web 2, as shown, comprises intertangled organic staple fibers 14. Also, as shown, optional size coat 15 coats binder 8 and phenolic particles 6. Abrasive article 1 includes work surface 21 and is attached to rotatable shaft 34 of a tool via attachment mechanism 35.

Abrasive articles for use with the method of the present invention comprise a nonwoven three-dimensional fibrous web reinforced with a scrim, wherein the first major surface of the fibrous web is needle tacked to the first major surface of the scrim. The scrim is preferably a woven stretch-resistant fabric with a low-stretch value when pulled in opposing directions. A stretch value of less than about 20% at break is preferred and a value of less than about 15% at break is more preferred. Suitable scrims include nylon mesh scrims, which are preferred, such as that commercially available from Highland Industries Inc., Greensboro, N.C. as "Style 6703832", as well as thermobonded fabrics, knitted fabrics, and stitch-bonded fabrics, and the like. Other suitable materials may be apparent to those skilled in the art after reviewing the disclosure of the present invention.

Suitable nonwoven webs for making abrasive articles for use with the method of the present invention are those comprised of staple fibers. Such nonwoven webs, as well as techniques for making the nonwoven webs (e.g., airlaid processes, spunbond processes, carding processes, garneting processes, wet lay processes, and combinations thereof) are well known in the art. Optionally, the web may be further processed using techniques known in the art, such as cross-lapping, calendering, spunlacing, hydroentanglement, and/or needletacking (i.e., an additional needletacking step prior to the needletacking to integrate the nonwoven/scrim composite).

Examples of staple fibers (i.e., fibers that are crimped and cut to a relatively short length) include natural fibers (e.g. cotton, wool, flax, etc.), synthetic fibers (e.g. polyamide, polyester, polyolefin, etc.), man-made fibers (e.g. viscose rayon), and combinations thereof (e.g., thermoplastic staple fibers (e.g., polyamides) and cellulosic staple fibers (e.g., viscose rayon) may be combined, where the weight percent of cellulosic fibers is typically in the range from 5 to 50 percent). Preferred staple fibers include polyamide fibers (e.g. nylon), polyester fibers, and polyolefin fibers. Typically, the staple fibers have a length less than about 15 cm, preferably less than about 10 cm, and most preferably less than about 7.5 cm, although fibers greater than 15 cm in length are also useful. In another aspect, the fibers typically have a diameter in the range from about 3 denier (3.3 dtex) per filament to about 200 denier (223 dtex) denier per filament. Such fiber diameters tend to produce webs having preferred structural integrity and exposed surface area at or near the web major surfaces.

Optionally, the nonwoven webs may contain melt-bondable fibers and or other binder to bond fibers together. Examples of melt-bondable fibers include sheath-and-core and collateral bicomponent fibers having an exposed heat activatable adhesive surface. Suitable binders, which may also serve as a "prebond" coating, are known in the art, and include those comprising polyacrylates, poly(ethylene acrylic acid), sytrene-butadiene polymers, combinations thereof, and those described in U.S. Pat. No. 5,082,720 (Hayes), the disclosure of which is incorporated herein by reference.

The reinforced nonwoven three-dimensional fibrous web is formed by needletacking the three-dimensional, fibrous nonwoven web onto the reinforcing scrim. Needletack processing is well known in the textile manufacturing art. With regard to the present invention, for example, the three-dimensional, fibrous web is introduced onto a coextensive reinforcing scrim such that major surfaces of the web and the scrim are in mutual contact. The contacted web and scrim are introduced into a needle loom such as, for example, that manufactured by Dilo Incorporated, Charlotte, N.C. During the needletacking process, at least a portion of the fibers of the three-dimensional, fibrous nonwoven web are mechanically encountered by the reciprocating barbed needles of the needle loom and translated into and through the reinforcing scrim, thus creating an integrated composite structure of reinforcing scrim having lofty fibrous layers on both major surfaces. The needletacking process produces a composite reinforced web of an intermediate density (volume basis) between the relatively low-density nonwoven web and the relatively high-density reinforcing scrim. Useful reinforced webs for the present invention preferably exhibit densities of between 0.03 g/cm$^3$ and 0.40 g/cm$^3$. Composite webs having densities less than 0.03 g/cm$^3$ tend to have less than desirable strength for rigorous use; whereas composite webs having densities greater than 0.40 g/cm$^3$ tend to provide abrasive articles having less desirable conformability characteristics (i.e., they made not readily conform to the workpiece surface(s)).

Optionally, the (needletacked) reinforced web includes a layer comprising a polymer applied over an exposed surface of the reinforced nonwoven web in the manner described in U.S. Pat. No. 5,482,756 (Berger et al.), the disclosure of which is incorporated herein by reference. This optional polymer layer may be used to provide additional reinforcement and offer a modified surface for contact with, for example, a contact wheel, when the article is employed as an endless belt. Optionally, a "prebond" resin (i.e., a hardenable binder precursor that is applied to the nonwoven web/scrim composite to further increase the strength of the composite prior to subsequent processing steps) is used to bond the fibers in the web to one another and to the reinforcing scrim at their mutual contact points. The prebond resin preferably comprises a coatable resinous adhesive binder precursor which, upon hardening by thermal or other curing mechanism, forms an adhesive layer to hold the fibers of the web to one another. Any of a variety of known materials may be used as a prebond resin including those described below. Preferred are materials which, upon hardening, form tough, flexible, rubbery or elastomeric binders. Preferred prebond resins include materials such as polyurethanes, polyureas, epoxies, styrene-butadiene rubbers, nitrile rubbers, and polyisoprene alone or in combination. Polyurethanes, polyureas, and epoxy-modified polyurethanes are more preferred, and preferred polyurethanes include those resulting from the reaction of an isocyanate with a polyol, such as is available in precursor form from Uniroyal Chemical Co., Middlebury, Conn., under the trade designation "BL-16".

The optional prebond coating may comprise any of a variety of thermoplastic materials. Alternatively, for example, the binders can be formed from materials that are capable of being crosslinked. It is also within the scope of this invention to have a mixture of thermoplastic binder and crosslinked binder. In the use of crosslinkable binder precursors, the binder precursor is exposed to an appropriate energy source to initiate polymerization or curing and to thereby form the hardened binder.

Suitable crosslinkable organic polymeric binder precursors can comprise either condensation curable resins or addition polymerizable resins. The addition polymerizable resins can be ethylenically unsaturated monomers and/or oligomers. Examples of crosslinkable materials include phenolic resins, bismaleimide binders, vinyl ether resins, aminoplast resins having pendant alpha, beta unsaturated carbonyl groups, urethane resins, epoxy resins, acrylate resins, acrylated isocyanurate resins, urea-formaldehyde resins, isocyanurate resins, acrylated urethane resins, acrylated epoxy resins, or mixtures thereof.

Examples of latex resins that can be mixed with phenolic resin include acrylonitrile butadiene emulsions, acrylic emulsions, butadiene emulsions, butadiene styrene emulsions and combinations thereof. These latex resins are commercially available from a variety of different sources and include those commercially available under the trade designations "RHOPLEX" and "ACRYLSOL" from Rohm and Haas Company, Philadelphia, Pa., "FLEXCRYL" and "VALTAC" from Air Products & Chemicals Inc., Allentown, Pa.; "SYNTHEMUL" and "TYLAC" from Reichhold Chemical Co., Research Triangle Park, N.C.; "HYCAR" and "GOODRITE" from B. F. Goodrich, Cleveland, Ohio; "CHEMIGUM" from Goodyear Tire and Rubber Co., Akron, Ohio; "NEOCRYL" from ICI, Wilmington, Del.; "BUTAFON" from BASF, Mt. Olive, N.J.; and "RES" from Union Carbide, Chicago, Ill.

Epoxy resins have an oxirane group and are polymerized by ring opening. Such epoxide resins include monomeric epoxy resins and polymeric epoxy reins. These resin can vary greatly in the nature of their backbones and substituent groups. For example, the backbone may be of any type normally associated with epoxy resins and substituent groups thereon can be any group free of an active hydrogen atom that is reactive with an oxirane group at room temperature. Representative examples of acceptable substituent groups include halogens, ester groups, ether groups, sulfonate groups, siloxane groups, nitro groups and phosphate groups. Examples of some preferred epoxy resins include 2,2-bis[4-(2,3-epoxypropoxy)-phenyl)propane (diglycidyl ether of bisphenol A)] and commercially available materials under the trade designations "EPON 828", "EPON 1004", and "EPON 1001F" from Shell Chemical Co., Houston, Tex.; and "DER-331", "DER-332" and "DER-334" from Dow Chemical Co., Midland, Mich. Other suitable epoxy resins include glycidyl ethers of phenol formaldehyde novolac, such as those available under the trade designations "DEN-431" and "DEN-428" from Dow Chemical Co.

Examples of ethylenically unsaturated binder precursors include aminoplast monomer or oligomer having pendant alpha, beta unsaturated carbonyl groups, ethylenically unsaturated monomers or oligomers, acrylated isocyanurate monomers, acrylated urethane oligomers, acrylated epoxy monomers or oligomers, ethylenically unsaturated monomers or diluents, acrylate dispersions or mixtures thereof.

Aminoplast binder precursors have at least one pendant alpha, beta-unsaturated carbonyl group per molecule or oligomer. These materials are further described in U.S. Pat. No. 4,903,440 (Kirk et al.) and U.S. Pat. No. 5,236,472 (Kirk et al.), the disclosures of which as incorporated herein by reference.

Ethylenically unsaturated monomers or oligomers may be monofunctional, difunctional, trifunctional or tetrafunctional or even higher functionality. The term "acrylate", as used herein, is intended to include both acrylates and methacrylates. Ethylenically unsaturated binder precursors include both monomeric and polymeric compounds that contain atoms of carbon, hydrogen and oxygen, and optionally, nitrogen and the halogens. Oxygen or nitrogen atoms or both are generally present in ether, ester, urethane, amide, and urea groups. Ethylenically unsaturated compounds preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of ethylenically unsaturated monomers include methyl methacrylate, ethyl methacrylate, styrene, divinylbenzene, hydroxy ethyl acrylate, hydroxy ethyl methacrylate, hydroxy propyl acrylate, hydroxy propyl methacrylate, hydroxy butyl acrylate, hydroxy butyl methacrylate, vinyl toluene, ethylene glycol diacrylate, polyethylene glycol diacrylate, ethylene glycol dimethacrylate, hexanediol diacrylate, triethylene glycol diacrylate, trimethylolpropane triacrylate, glycerol triacrylate, pentaerthryitol triacrylate, pentaerythritol trimethacrylate, pentaerythritol tetraacrylate and pentaerythritol tetramethacrylate. Other ethylenically unsaturated resins include monoallyl, polyallyl, and polymethallyl esters and amides of carboxylic acids, such as diallyl phthalate, diallyl adipate, and N,N-diallyladipamide. Still other nitrogen containing compounds include tris(2-acryl-oxyethyl) isocyanurate, 1,3,5-tri(2-methyacryloxyethyl)-s-triazine, acrylamide, methylacrylamide, N-methyl-acrylamide, N,N-dimethylacrylarnide, N-vinyl-pyrrolidone, and N-vinyl-piperidone.

Isocyanurate derivatives having at least one pendant acrylate group and isocyanate derivatives having at least one pendant acrylate group are further described in U.S. Pat. No. 4,652,274 (Boettcher et al.), the disclosure of which is incorporated herein by reference. A preferred isocyanurate material is a triacrylate of tris(hydroxy ethyl) isocyanurate.

Acrylated urethanes are diacrylate esters of hydroxy terminated isocyanate extended polyesters or polyethers. Examples of commercially available acrylated urethanes include those available under the trade designations "UVITHANE 782" from Morton International, Chicago, Ill. and "CMD 6600", "CMD 8400", and "CMD 8805" from UCB Radcure Specialties, Symrna, Ga. Acrylated epoxies are diacrylate esters of epoxy resins, such as the diacrylate esters of bisphenol A epoxy resin. Examples of commercially available acrylated epoxies include those available under the trade designations "CMD 3500", "CMD 3600", and "CMD 3700" from UCB Radcure Specialties, Symrna, Ga.

Acrylated urethanes are diacrylate esters of hydroxy terminated NCO extended polyesters or polyethers. Examples of commercially available acrylated urethanes include those available under the trade designations "UVITHANE 782" from Morton International, Chicago, Ill., and "CMD 6600", "CMD 8400", and "CMD 8805" from Radcure Specialties.

Acrylated epoxies are diacrylate esters of epoxy resins, such as the diacrylate esters of bisphenol A epoxy resin. Examples of commercially available acrylated epoxies include those available under the trade designations "CMD 3500", "CMD 3600", and "CMD 3700" from Radcure Specialties.

Examples of ethylenically unsaturated diluents or monomers can be found in U.S. Pat. No. 5,236,472 (Kirk et al.) and U.S. Pat. No. 5,667,842 (Larson et al.), the disclosures of are incorporated herein after by reference. In some instances these ethylenically unsaturated diluents are useful because they tend to be compatible with water.

Additional details concerning acrylate dispersions can be found, for example, in U.S. Pat. No. 5,378,252 (Follensbee), the disclosures of are incorporated herein after by reference.

It is also within the scope of this invention to use a partially polymerized ethylenically unsaturated monomer in the binder precursors used herein. For example, an acrylate monomer can be partially polymerized and incorporated into an abrasive slurry (e.g. a slurry of binder precursor with abrasive particles). The degree of partial polymerization should be controlled so that the resulting partially polymerized ethylenically unsaturated monomer does not have an excessively high viscosity so that the resulting abrasive slurry can be coated to form the abrasive article. An example of an acrylate monomer that can be partially polymerized is isooctyl acrylate. It is also within the scope of this invention to use a combination of a partially polymerized ethylenically unsaturated monomer with another ethylenically unsaturated monomer and/or a condensation curable binder.

The foregoing prebond binder precursors may further comprise optional additives (e.g., particle surface modification additives, coupling agents, plasticizers, fillers, expanding agents, fibers, antistatic agents, initiators, suspending agents, photosensitizers, lubricants, wetting agents, surfactants, pigments, dyes, UV stabilizers, suspending agents, and the like) in amounts suitable to provide the properties desired. The selection of appropriate additives and the amounts thereof may readily be determined by those skilled in the art.

The addition of a suitable plasticizer can increase the erodibility of the abrasive coating and soften the overall binder hardness. The plasticizer should be in compatible with the binder precursor to avoid phase separation when the precursor is still in a coatable or liquid state. Examples of possible plasticizers include polyvinyl chloride, dibutyl phthalate, alkyl benzyl phthalate, polyvinyl acetate, polyvinyl alcohol, cellulose esters, phthalate, silicone oils, adipate and sebacate esters, polyols, polyol derivatives, t-butylphenyl diphenyl phosphate, tricresyl phosphate, castor oil, combinations thereof and the like.

A filler typically comprises a particulate material and generally has an average particle size range between 0.1 to 50 micrometers, typically between 1 to 30 micrometers. Examples of useful fillers include metal carbonates (such as calcium carbonate (chalk, calcite, marl, travertine, marble and limestone), calcium magnesium carbonate, sodium carbonate, magnesium carbonate), silica (such as quartz, glass beads, glass bubbles and glass fibers) silicates (such as talc, clays, (montmorillonite) feldspar, mica, calcium silicate, calcium metasilicate, sodium aluminosilicate, sodium silicate) metal sulfates (such as calcium sulfate, barium sulfate, sodium sulfate, aluminum sodium sulfate, aluminum sulfate), gypsum, vermiculite, wood flour, aluminum trihydrate, carbon black, metal oxides (such as calcium oxide (lime), tin oxide (e.g. stannic oxide), titanium dioxide) and metal sulfites (such as calcium sulfite), thermoplastic particles (polycarbonate, polyetherimide, polyester, polyethylene, polysulfone, polystyrene, acrylonitrile-butadiene-styrene block copolymer, polypropylene, acetal polymers, polyurethanes, nylon particles) and thermosetting particles (such as phenolic bubbles, phenolic beads, polyurethane foam particles and the like). The filler may also be a salt such as a halide salt. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metal fillers include, tin, lead, bismuth, cobalt, antimony, cadmium, iron titanium. Other miscellaneous fillers include sulfur, organic sulfur compounds, graphite, and metallic sulfides. It will be understood that the above fillers constitute a representative sampling and not a complete list of possible fillers for use herein.

Examples of antistatic agents include graphite, carbon black, vanadium oxide, conductive polymers, humectants, and the like. Antistatic agents are disclosed, for example, in U.S. Pat. No. 5,061,294 (Harmer et al.), U.S. Pat. No. 5,137,542 (Buchanan et al.), and U.S. Pat. No. 5,203,884 (Buchanan et al.), the disclosures of which is incorporated herein by reference.

The foregoing binder precursors may further comprise a curing agent to initiate and complete the polymerization or crosslinking process required in the conversion of the binder precursor into a binder. The term curing agent encompasses initiators, photoinitiators, catalysts and activators. The amount and type of the curing agent will depend largely on the chemistry of the binder precursor, as known by those skilled in the art.

The prebond resin can be applied to the web, for example, in a relatively light coating, typically one which provides a dry add-on weight of at least about 150 g/m$^2$. However, those skilled in the art will appreciate that the selection and amount of resin actually applied can depend on any of a variety of factors including, for example, the fiber weight in the nonwoven web, the fiber density, the fiber type as well as the contemplated end use for the finished article.

The optional prebond resin can be applied, for example, via methods familiar to those of ordinary skill, including spray coating and roll coating, and is at least partially cured or hardened by application of thermal or other appropriate energy.

Following the optional application of a prebond coating, a make coat resin is applied to at least one major surface of the reinforced nonwoven web. Preferably, the make coat is applied to the second major surface (i.e., opposite the side to which the scrim was applied). The make coat may comprise any coatable binder precursor as described as useful for the prebond resin. Preferably, the make coat is a hard polymeric thermosetting binder such as, for example, epoxy resins or phenolic resins. More preferably, the make coat comprises thermosetting phenolic resins. Thermosetting phenolic resins such as resole and novolac resins are described in Kirk-Othmer, Encyclopedia of Chemical Technology, 3d Ed. John Wiley & Sons, 1981, New York, Vol. 17, pp. 384–399, the disclosure of which is incorporated herein by reference. Resole phenolic resins are made with an alkaline catalyst and a molar excess of formaldehyde, typically having a molar ratio of formaldehyde to phenol between 1.0:1.0 and 3.0:1.0. Novolac resins are prepared under acid catalysis and with a molar ratio of formaldehyde to phenol less than 1.0:1.0. A typical resole resin useful in the manufacture of articles for the present invention contains between about 0.75% (by weight) and about 1.4% free formaldehyde; between about 6% and about 8% free phenol; about 78% solids with the remainder being water. The pH of such a resin is about 8.5 and the viscosity is between about 2400 and about 2800 centipoise. Commercially available phenolic resins suitable for use in the present invention include those under the trade designations "DUREZ" and "VARCUM", available from Occidental Chemicals Corporation (North Tonawonda, N.Y.); "RESINOX", available from Monsanto Corporation, St. Louis, Mo.; and "AROFENE" and "AROTAP", both available from Ashland Chemical Company, Columbus, Ohio; as well as the resole precondensate available under the trade designation "BB077" from Neste Resins, a Division of Neste Canada, Inc., Mississauga, Ontario, Canada. Organic solvent may be added to the phenolic resin as needed or desired.

The make coat may further comprise optional additives, such as, particle surface modification additives, coupling agents, plasticizers, fillers, expanding agents, fibers, antistatic agents, initiators, suspending agents, photosensitizers, lubricants, wetting agents, surfactants, pigments, dyes, UV stabilizers, suspending agents and the like in amounts suitable to provide the properties desired, as described above. The (make) coating can be conveniently applied, for example, via methods familiar to those of ordinary skill, including spray coating and roll coating.

The phenolic particles can be derived, for example, from any of the aforementioned phenolic resins. The phenolic particles can be made by hardening or curing a thermosetting phenolic resin, which optional includes other additives (e.g., fillers such as talc, wollastonite, or any of the fillers described previously), and comminuting, pulverizing, or otherwise reducing the size of the hardened thermosetting resin as needed. Useful fillers for incorporation phenolic particles exclude hard, abrasive materials larger than 6 micrometers having a mohs hardness of greater than 7 (e.g., silicon carbide or aluminum oxide), as such abrasive materials are prone to adversely alter the surface finish of the workpiece. Following appropriate size reduction step, the phenolic particles are screened or otherwise classified to provide the desired size(s). Preferably, the phenolic particles are derived from resole phenolic resins such as the resole precondensate available under the trade designation "BB077" from Neste Resins, a Division of Neste Canada, Inc., Mississauga, Ontario, Canada.

Useful phenolic particles typically have an aspect ratio of less than about 2 (i.e., the ratio of the largest to smallest dimension) and exhibit an effective diameter (i.e., the dimension of an opening in the smallest sieve through which the phenolic particles will pass) in the range of from about 150 to about 2400 micrometers. Phenolic particles less than about 150 micrometers tend to produce abrasive articles requiring longer times to remove residual gasket material; whereas phenolic particles greater than about 2400 micrometers tend to provide fewer working contact points at work surfaces and, due to their relatively smaller surface area to particle volume ratio, are more difficult to durably bond to the reinforced nonwoven web. In another aspect, the phenolic particles typically have a hardness of at least 90 HRM as measured by ASTM D-785-98, the disclosure of which is incorporated herein by reference.

The phenolic particles may be applied to a major surface of the nonwoven web, for example, via apply the (make) binder precursor onto the major surface, and then drop coating and/or electrostatic coating the phenolic particles. The phenolic particles may be also be applied to a major surface of the nonwoven web, for example, by spray or and/or roll coating a slurry comprising binder precursor and the phenolic particles.

Following application of the binder precursor and the phenolic particles, the resulting composition is at least partially cured or otherwise hardened by using thermal or other energy means, as is well known to those of ordinary skill. The resulting abrasive article typically has a phenolic particle add-on weight of in the range from about 50 g/m$^2$ to about 700 g/m$^2$, preferably, in the range from about 150 g/m$^2$ to about 400 g/m$^2$.

Optionally, a one or more size coatings are applied over the phenolic particles and binder. Such coatings provide further bonding of the phenolic particles, and/or other functional qualities such as, for example, lubrication, static control, or color. The size coatings may comprise any of the materials identified in the descriptions of the prebond or make coatings, above, and may be applied, for example, by spray coating, roll coating, or other convenient method. The size coating(s) are cured or hardened by methods known in the art (e.g., heating).

Abrasive articles for the method of the present invention may be in the form of sheets, squares, rectangles, circular discs, endless belts, brushes, wheels (e.g., a plurality of discs may be ganged together), etc. A preferred form of an abrasive article for the method of the present invention is a disc form, preferably having a diameter in the range from about 2 cm to about 20 cm.

Embodiments for the present invention include those having attachment mechanisms such as those facilitating attachment to a tool (including those having an air or electric motor driven shaft (e.g., a right-angle (electric) power tool)). A variety of suitable attachment mechanisms are known in the abrasive art, some of which include the use of a support or back up pad. Preferred attachment mechanisms are described, for example, in U.S. Pat. No. 3,667,170 (MacKay) and U.S. Pat. No. 3,270,467 (Block), the disclosures of which are incorporated herein by reference. Another preferred attachment mechanisms is the integrally-molded threaded stud adapted for screw-type engagement with a rotary tool as reported in U.S. Pat. No. 3,562,968 (Johnson et al.), the disclosures of which are incorporated herein by reference. The latter is preferred for circular or disc shaped articles, and preferably, the attachment mechanism is centered relative to the abrasive disc for proper rotation. Suitable attachment mechanisms may be made, for example, from thermoplastic polymeric materials, thermosetting polymeric materials, and/or metals.

Other suitable attachment mechanisms include use a hook and loop as reported, for example, in U.S. Pat. No. 5,077,870 (Melbye et al.), the disclosure of which is incorporated herein by reference, or as commercially available from the 3M Company, St. Paul, Minn., under the trade designation "SCOTHMATE". Another suitable attachment mechanism for embodiments for the present invention is a hermaphroditic fastener such as that commercially available from the 3M Company under the trade designation "DUAL LOCK". Another suitable attachment mechanism for embodiments for the present invention is an intermeshing structured surfaces such as reported in U.S. Pat. No. 4,875,529 (Appeldorn), the disclosure of which is incorporated herein by reference. Further, for example, disc forms for the present invention may have one or more holes or openings so that the abrasive disc may be mechanically secured (such as with a bolt and nut) to a back up pad.

Preferred tools for using disc forms for the method of the present invention include right angle (electric) power tools known in the art (available, for example, from Ingersoll-Rand, Woodclifflake, N.J. under the trade designation "CYCLONE"; model TA 180 RG4; rated at 18,000 rpm and 0.70 hp). A suitable back-up pad arrangement for use with such right angle tools is reported in U.S. Pat. No. 3,562,968 (Johnson et al.), the disclosure of which is incorporated herein by reference.

Advantages and embodiments of this invention are further illustrated by the following examples, but the particular materials and amounts thereof recited in these examples, as well as other conditions and details, should not be construed to unduly limit this invention. All parts and percentages are by weight unless otherwise indicated.

EXAMPLES

Example 1

Example 1 was prepared using an air laid, nonwoven web made from a fiber blend of 75% by weight of 1.5 inch (38 mm) long 70 denier per filament (78 dtex) nylon staple 2 fibers and 25% by weight of 1.5 inch (38 mm) long 58 denier per filament (65 dtex) nylon staple fibers. This fiber web was then needle punched into a nylon mesh scrim ("Style 6703832", commercially available from Highland Industries Inc., Greensboro, N.C.). The resulting scrim-reinforced web was subsequently coated with a urethane, pre-bond resin (commercially available from Uniroyal Chemical Co., Gastonia, N.C., under the trade designation "ADIPRENE BL-16") and cured for 15 minutes at 135° C., providing a dry add on weight of 0.13 gm/cm$^2$.

The resulting composite web was die cut to a 2-inch (50.7 mm) diameter disc. A nylon drive button to facilitate attachment to a high-speed die grinder was spin-welded (spin welder built for the 3M Company by Engineering Unlimited Inc., Minneapolis, Minn.) to the back of the composite disc so as to melt bond the fastener to the disc. The spin weld was accomplished at about 4500 rpm and under a force of about 500 lbs. imparted by a cylinder.

Phenolic particles were prepared from a liquid phenolic resin (a water-based phenolic resin available from Neste Resins, Canada under the trade designation "BB-077"). The liquid phenolic resin was poured in to an aluminum foil pan to a depth of about ½ inch (12.7 mm). This pan was placed in a lab oven and cured sequentially at 88° C. for 60 minutes, 93° C. for 120 minutes, 99° C. for 45 minutes, 104° C. for 100 minutes, and 116° C. for 15 minutes, wherein the heating rate from one temperature to another was 6° C./min. The resulting cured phenolic sheet was broken with a hand mallet to pieces having a major axis dimension of up to about 50 mm. These phenolic pieces were farther reduced in size using a pelletizer (available from C W Brabender Instruments, Inc., So. Hackensack, N.J.). The pelletized phenolic particles were then screened using U.S. Standard sieves (obtained from W. S. Tyler Company, Mentor, Ohio). Phenolic particles that passed through a #18 sieve and were retained on #20 sieve were placed in to the bottom of a 2-inch (50.7 mm) diameter aluminum foil dish.

Liquid phenolic resin ("BB-077") was poured into glass pan to form a shallow film layer. The side of the composite web disc opposite the scrim was placed in the bottom of the glass pan and pressed by hand to coat the web fibers on the side opposite the scrim. The phenolic resin-coated disc was placed into the dish and pressed by hand until particles were observed to coat the entirety of the disc face. The liquid phenolic resin was cured for 90 minutes at 93° C., 40 minutes at 99° C., 30 minutes at 104° C., and 30 minutes at 116° C., wherein the heating rate from one temperature to another was 6° C./min. The resulting abrasive article had a cured phenolic resin add-on weight of 2.1 grams, and a phenolic particle add-on weight of 1.2 gram.

Example 2

Example 2 was prepared as describe for Example 1, except the phenolic particles contained talc. These phenolic particles were made by hand mixing 100 grams of talc (commercially available from Luzenac America, Inc., Englewood, Colo., under the trade designation "TALC 325 BEAVERWHITE") into 700 grams of liquid phenolic resin ("BB-077"). The resulting mixture was cured, crushed, and the particles passing through a #18 sieve and retained on a #20 sieve coated onto the reinforced nonwoven web as described in Example 1. The resulting abrasive article had a cured phenolic resin add-on weight of 1.7 gram, and a phenolic particle add-on weight of 1.0 gram.

Example 3

Example 3 was prepared as describe for Example 1, except the phenolic particles contained wollanstonite. These phenolic particles were made by hand mixing 100 grams of grade 400 mesh wollanstonite (commercially available from NYCO Minerals Inc., Calgary, Alberta, Canada, under the trade designation "NYADM 400") into 700 grams of liquid phenolic resin ("BB-077"). The resulting mixture was cured, crushed, and the particles passing through a #18 sieve and retained on a #20 sieve coated onto the reinforced nonwoven web as described in Example 1. The resulting abrasive article had a cured phenolic resin add-on weight of 2.0 gram, and a phenolic particle add-on weight of 0.9 gram.

Example 4

Example 4 was prepared as describe for Example 1, except the phenolic particles were molding particles (available from Plastics Engineering Company, Sheboygan, Wis., under the trade designation "PLENCO 4527"). The as received particles were classified by passing them through a series of sieves, and the particles coated onto the reinforced nonwoven web were those passing through a #18 sieve and retained on a #20 sieve. The resulting abrasive article had a cured phenolic resin add-on weight of 1.1 gram, and a phenolic particle add-on weight of 1.25 gram. A size coat of an epoxy-modified polyurethane was applied by brush and cured at 135° C. for 30 minutes to provide a dry add-on of 0.4 gram. The size coat consisted of 40.5% by weight of urethane prepolymer (commercially available from Uniroyal Chemical Co., Gastonia, N.C. under the trade designation "ADIPRENE BL-31"); 38.17% of a premix (consisting of 31.7% epoxy prepolymer (commercially available under the trade designation "EPON 828" from Shell Oil Company, Houston, Tex.), 28.3% isophorone diamine (commercially available from Degussa-Huls Corporation, Ridgefield Park, N.J.), and 40% propylene glycol monoethyl ether acetate (commercially available under the trade designation "PM ACETATE" from Arco Chemical Company, Houston, Tex.); and 21.32% propylene glycol monomethyl ether (commercially available under the trade designation "POLY-SOLV" from Lyondell Chemical Company, South Charleston, W. Va.).

Example 5

Example 5 was prepared using pieces (12 inch (30.5 cm) wide by 1 meter long) of an air laid, nonwoven web as described in Example 1. These pieces were roll coated with liquid phenolic resin ("BB-077"). While the resin was still wet (i.e., a liquid), phenolic particles (prepared as described in Example 1) were dropped from a conveyor belt on to the phenolic-coated web. The resulting material was cured by passing it four times, at 2.1 meters/minute, through a 4.6 meter long forced convection oven set at 177° C. A size coat as described in Example 4 was applied utilizing a reciprocating (45 reciprocations per minute) spray gun (obtained from Midway Industrial Supply Co., St. Paul, Minn. under the trade designation "BINKS; #601" equipped with spray nozzle #67). The size coating was cured by again passing it four times, 2.1 meters/minute, through the 4.6 meter long oven set at 177° C. The abrasive articles had a fiber web weight of 825 g/m$^2$, a phenolic resin add-on weight of 406 g/m$^2$, a phenolic particles add-on weight of 502 g/m$^2$, and a size coat add-on weight of 167 g/m$^2$.

Example 7

Example 7 was prepared as describe for Example 1, except the phenolic particles contained talc. These phenolic particles were made by hand mixing 150 grams of talc ("325 BEAVERWHITE") into 300 grams of liquid phenolic resin ("BB-077"). The resulting mixture was cured, crushed, and the particles that passed through a #20 sieve and retained on a #40 sieve coated onto the reinforced nonwoven web as described in Example 1. The resulting abrasive article had an add-on weight from the cured phenolic resin of 1.4 gram, and 0.9 gram from the talc containing phenolic particles. A size coat of epoxy-modified polyurethane as described in Example 4 was applied by brush and cured also as described in Example 4 to produce a dry add-on of 0.4 gram.

Example 8

Example 2 was prepared as describe for Example 1, except the phenolic particles contained calcium carbonate. These phenolic particles were made by hand mixing 1200 grams of calcium carbonate (available from J. M. Huber Corp., Quincy, Ill., under trade designation "HUBERCARB Q325"), 32 grams of amorphous fumed silica (available from Cabot Corp., Tuscola, Ill., under the trade designation "CAB-O-SIL M-5"), and 2400 grams of liquid phenolic resin ("BB-077"). The resulting mixture was cured, crushed, and the particles passing through a #20 sieve and retained on a #40 sieve coated onto the reinforced nonwoven web as described in Example 1.

The resulting abrasive article had an add-on weight from the cured phenolic resin of 1.4 gram, and 0.9 gram from the calcium carbonate containing phenolic particles. An additional size coat of an epoxy-modified polyurethane was applied by brush and cured (as described in Example 4) to produce a cured add-on of 0.4 gram.

Example 9

Example 9 was prepared using pieces (12 inch (30.5 cm) wide by 1 meter long) of an air laid, nonwoven web as described in Example 1, except the phenolic particles were roll crushed phenolic particles with a range of particle sizes. These pieces of the web were spray coated with a phenolic resin/phenolic particle slurry utilizing a reciprocating (45 reciprocations per minute) spray gun (as described in Example 5, but equipped with spray nozzle #59ASS).

The phenolic particles were prepared as described in Example 1 except the cured sheets broken with a hand mallet to pieces having a major axis dimension of up to about 50 mm, these phenolic pieces were farther reduced in size using a roll crusher equipped with 6" diameter and 6" wide rolls (obtained from Allis-Chalmers, Milwaukee, Wis.), and then screened to retain the particles passing through a #20 sieve and retained on a #38 sieve.

The phenolic resin/phenolic particle slurry was prepared by mixing 77.5 percent by weight phenolic resin ("BB-077"), 12 percent by weight water, and 10.5 percent by weight of the phenolic particles.

The coated web was cured as described in Example 5. Further, a size coat was applied and cured as described in Example 5, except the size coat comprised 37.7 percent by weight urethane prepolymer (available from Uniroyal Chemical Co. under the trade designation "ADIPRENE BL-16"), 27.6 percent by weight of the epoxy-modified polyurethane described in Example 4, and 34.7 percent by weight propylene glycol monomethyl ether ("POLY-SOLV").

The abrasive articles had a fiber web weight of 816 g/m$^2$, a cured phenolic resin/phenolic particle add-on weight of 988 g/m$^2$, and a cured size coat add-on weight of 172 g/m$^2$.

Example 10

Example 10 demonstrates the ability to employ classification waste (i.e., previously crushed but not yet used sieve size particles) to make composite phenolic particles, (i.e., phenolic particles that contain previously-made phenolic particles) in the abrasive article.

Example 10 was prepared as describe for Example 1, except the phenolic particles were made as follows. About 47 grams of the unused (uncoated) particles prepared for Example 1 were classified through sieves and the fraction passing through a #10 sieve but retained on a #40 sieve was set aside. About 23 grams of the unused particles prepared for Example 8 were classified through sieves and the fraction passing though a #10 sieve but retained on a #40 sieve was collected and added to the previously set aside particles. The combined fractions were then mixed into 100 grams of liquid phenolic resin ("BB-077"). The resulting mixture was cured, crushed, and screened as described in Example 1, except the size of the particles used to make the abrasive article were those that passed through the #20 sieve, but were retained on the #40 sieve. The resulting abrasive article had a cured phenolic resin add-on weight of 1.5 gram, and a phenolic particle add-on weight of 0.6 gram.

Example 11

Example 2 was prepared as describe for Example 1, except the phenolic particles contained calcium carbonate. These phenolic particles were made by hand mixing 1045 grams of calcium carbonate ("HUBERCARB Q325"), 16 grams of amorphous fumed silica ("CAB-O-SIL M-5"), and 1210 grams of liquid phenolic resin ("BB-077"). The resulting mixture was cured, crushed, and the particles passing through a #16 sieve and retained on a #18 sieve, coated onto the reinforced nonwoven web as described in Example 1. The resulting abrasive article had an add-on weight from the cured phenolic resin of 1.5 gram, and 1.0 gram from the calcium carbonate containing phenolic particles. A size coat of 46.9 percent by weight urethane prepolymer ("ADIPRENE BL-31"), 11.1 percent by weight a urethane curative (commercially available under the trade designation "LONZACURE M-DEA" from Lonza A G, Werke, Switzerland), 25.9 percent by weight propylene glycol monomethyl ether acetate (commercially available under the trade designation "UCAR PM" from Union Carbide Corp, South Charleston, W. Va.), and 16.1 percent by weight xylol (commercially available from Shell Chemical, Houston, Tex.)) was applied by brush and cured (as described in Example 4) to produce a cured add-on of 1.0 gram.

Example 12

Example 12 was prepared as described for Example 7, except the phenolic particles used were those that passed through a #16 sieve and were retained on a #18 sieve. The resulting abrasive article had an add-on weight from the cured phenolic resin of 1.2 gram, and 0.9 gram from the phenolic particles. The disc was size coated as described in Example 11 to provide a cured add-on weight of 1.0 gram.

Example 13

Example 13 was prepared as described for Example 1 except as follows. The phenolic particles used were those that passed through a #16 sieve and were retained on a #18 mesh sieve. A size coat was provided as described in Example 11. The resulting abrasive article had a backing weight of 1.7 gram, an add-on weight from the cured phenolic resin of 1.1 gram, 1.2 gram from the phenolic particles, and 1.0 from the cured size coat.

Example 14

Example 14 was prepared as described for Example 1 except as follows. The phenolic particles were prepared as described in Example 11, and passed through a #16 sieve and but were retained on a #18 mesh sieve. A size coat was applied as described in Example 11. The resulting abrasive article had a backing weight of 1.7 gram, an add-on weight from the cured phenolic resin of 0.9 gram, 0.9 gram from the phenolic particles, and 1.0 from the cured size coat.

Example 15

Example 15 was prepared as described for Example 1 except as follows. The final cure temperature for the phenolic particles was 177° C. for 30 minutes. The particles used were those that passed through a #16 sieve and but were retained on a #18 mesh sieve. A size coat was applied as described in Example 11. The resulting abrasive article had a backing weight of 1.7 gram, an add-on weight from the cured phenolic resin of 1.2 gram, 1.0 gram from the phenolic particles, and 1.0 from the cured size coat.

Example 16

Example 16 was prepared as described for Example 11 except as follows. The final cure temperature for the phenolic particles was 177° C. for 30 minutes. The particles used were those that passed through a #16 sieve and but were retained on a #18 mesh sieve. The resulting abrasive article had a backing weight of 1.7 gram, an add-on weight from the cured phenolic resin of 0.9 gram, 1.0 gram from the phenolic particles, and 1.0 from the cured size coat.

Comparative Example A

A Comparative Example A disc was made as in Example 1, except no phenolic particles were used, and a size coat was applied as described in Example 11. The resulting abrasive article had a backing weight of 1.7 gram, an add-on weight from the cured phenolic resin of 1.6 gram, and 1.0 from the cured size coat.

Comparative Example B

Comparative Example B was a 2 inch (50.7 mm) diameter nonwoven abrasive disc commercially available under the trade designation "A-MED ROLOC SURFACE CONDITIONING DISC" from the 3M Company. This disc is marketed to remove common gasket materials, and comprises a nonwoven backing similar to the backing utilized in Examples 1–16, and has an abrasive layer comprised of 120–150 mesh aluminum oxide abrasive particles and cured phenolic resin.

Comparative Example C

Comparative Example C was a 2-inch (50.7 mm) diameter bristle disc commercially available under the trade designation "3M ROLOC BRISTLE DISC, GRADE 120" from the 3M Company. The disc is marketed to remove common gasket materials, and is made from a polymeric extrusion that contains 120 mesh aluminum oxide abrasive particles.

Comparative Example D

Comparative Example D was a 2 inch (50.7 mm) diameter nonwoven disc commercially available under the trade designation "A-CRS ROLOC SURFACE CONDITIONING DISC" from the 3M Company. The disc is marketed to remove common gasket materials, and comprises the nonwoven backing utilized to prepare Examples 1–16, and an abrasive layer comprised of 80 mesh aluminum oxide abrasive particles and cured phenolic resin.

Comparative Example E

Comparative Example E was prepared as described for Example 1, except walnut shell particulate passing through a #30 sieve but retained on a #100 sieve; available from Composition Materials Co., East Fairfield, Conn.) was used in place of the phenolic particles. Further, a cured size coat was provided as described in Example 9. The resulting abrasive article had a backing weight of 1.7 gram, an add-on weight from the cured phenolic resin of 1.1 gram, 0.5 gram from the walnut shells, and 0.2 gram from the cured size coat.

Comparative Example F

Comparative Example F was prepared as described for Example 1, except particulate melamine formaldehyde passing through a #60 sieve but retained on a #100 sieve; available from Maxi-Blast Inc., South Bend, Ind., under the trade designation "MC TYPE III") was used in place of the phenolic particles. The cured phenolic resin and particle add-on weights were about equal to those of Example 1.

Comparative Example G

Comparative Example G was prepared as describe for Example 1, except the phenolic particles contained 4-micrometer silicon carbide. These phenolic particles were made by hand mixing 40 grams of 4-micrometer silicon carbide (available from Fujimi Corp, Addison, Ill., under the trade designation "C3000") into 72 grams of liquid phenolic resin ("BB-077"). The resulting mixture was cured, crushed, and particles that passed through a #10 sieve and retained on a #25 sieve coated onto the reinforced nonwoven web as described in Example 1. The resulting abrasive article had an add-on weight from the cured phenolic resin of 1.1 gram phenolic resin, and 1.2 gram from the silicon carbide-containing phenolic particles.

Examples 1–5 and 7–16, and Comparative Examples A–G were tested according to the Gasket Material Removal Test, the Metal Removal Test, and the Surface Roughness Change Test, described below. The results are shown in Table 1, below.

TABLE 1

| Example | Particle | Mesh Size | Gasket material removal, seconds | Metal Removal, g | ΔRa, microinches, (micrometer) |
|---|---|---|---|---|---|
| 1 | Phenolic | 20 | 45 | 0.0 | 1 (0.02) |
| 2 | phenolic w/talc | 20 | 51 | 0.0 | 2 (0.05) |
| 3 | Phenolic w/ wollastonite | 20 | 48 | 0.0 | 2 (0.05) |
| 4 | Phenolic | 20 | 71 | 0.1 | 6 (0.15) |
| 5 | Phenolic | 18 | 33 | 0.0 | 3 (0.08) |
| 7 | phenolic w/talc | 40 | 40 | 0.0 | 5 (0.13) |
| 8 | phenolic w/calcium carbonate | 40 | 51 | 0.0 | 2 (0.05) |
| 9 | Phenolic | 20–38 | 50 | 0.0 | 1 (0.02) |
| 10 | phenolic w/phenolic recycle | 20–40 | 49 | 0.0 | 2 (0.05) |
| 11 | phenolic w/calcium carbonate | 18 | 52 | 0.0 | 2 (0.05) |
| 12 | phenolic w/talc | 18 | 50 | 0.0 | 2 (0.05) |
| 13 | Phenolic | 18 | 38 | 0.0 | 4 (0.10) |
| 14 | phenolic w/calcium carbonate | 18 | 43 | 0.0 | 5 (0.13) |
| 15 | Phenolic | 18 | 41 | 0.0 | 4 (0.10) |
| 16 | Phenolic w/calcium carbonate | 18 | 44 | 0.0 | 4 (0.10) |
| Comp. A | None | | 76 | 0.0 | 3 (0.08) |
| Comp. B | Aluminum oxide | 120–150 | 46 | 0.6 | 12 (0.30) |
| Comp. C | Aluminum oxide | 120 | 86 | 0.2 | 9 (0.23) |
| Comp. D | Aluminum oxide | 80 | 42 | 1.3 | 30 (0.76) |
| Comp. E | walnut shells | 30–100 | 87 | 0.0 | 3 (0.08) |
| Comp. F | melamine formaldehyde | 60–100 | 57 | 0.0 | 6 (0.15) |
| Comp. G | phenolic w/4 micrometer SiC | 10–25 | 37 | 0.0 | 6 (0.15) |

Gasket Material Removal Test

The amount of time required for gasket removal discs to remove gasket material was determined as follows. Gasket material (1/32 inch (0.79 mm) thick obtained from Carquest Corp., Lakewood, Colo. under the trade designation "VICTOLEX SHEET JV 125") was bonded to a 2" wide by ½" thick (5.08×1.27 cm) type 6061 aluminum bar (obtained from Ryerson & Son Inc., Plymouth, Minn.) with adhesive (available from the 3M Company under the designation "SUPER WEATHERSTRIP ADHESIVE"; part no 08001"). The test discs were attached to a disc holder (available from the 3M Company under the designation "ROLOC DISC PAD, 2 IN HARD", part number 051144-45096"). This disc/holder was then attached to a 20,000 RPM right angle tool (available from Ingersoll Rand Co, Woodclifflake, N.J. under the designation "CYCLONE CA200"). The tool, with test disc attached, was applied by hand with a force of approximately 1.5 to 2.0 kg. The time to remove 11.25 $in^2$ (72.6 $cm^2$) of the gasket material was recorded.

Metal Removal Test

The amount of metal removed by gasket removal discs was determined as follows. Test discs were attached to the right angle tool ("CYCLONE CA200") as described in the Gasket Removal Test. This tool, with test disc attached, was applied by hand with a force of approximately 1.5 to 2.0 kg for 60 seconds to a 36 inch long by 1-½ inch wide by ½ inch thick (91.4×3.8×1.27 cm) type 6061 aluminum bar (obtained from Ryerson & Son Inc., Plymouth, Minn.). The weight loss in grams of the aluminum bar was recorded.

Surface Roughness Change Test

The effect a gasket removal disc has on the surface roughness of aluminum was determined as follows. The tool and aluminum bar stock are as described in the metal removal test. An initial surface roughness, $R_a$ (in microinches) of the aluminum surface was measured with a surface profile meter (available from Flexbar Machine Corp., Islandia, N.Y. under the designation "POCKETSURF III"). The test disc was applied to the aluminum metal surface (to the area where the initial surface roughness measurement was taken) with a force of approximately 1.5 to 2.0 kg for 4 seconds. A second $R_a$ measurement was taken and the change in surface roughness, $\Delta R_a$, recorded.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A method of removing gasket material from a substrate, the method comprising:

providing abrasive article having a work surface, the abrasive article comprising:

a scrim having a first major surface;

a nonwoven, three dimensional fibrous web having first and second major surfaces, wherein the first major surface of the fibrous web is needle tacked to the first major surface of the scrim; and an abrasive layer having work surface secured to the second major surface of the fibrous web, the abrasive layer comprised of binder and a plurality of phenolic particles, wherein the phenolic particles at the work surface are free of abrasive particles larger than 6 micrometers;

frictionally engaging at least a portion of the work surface of the abrasive article with the gasket material to be removed; and inducing relative motion between the abrasive article and the gasket material to be removed to remove at least a portion of the gasket material.

2. The method according to claim 1 wherein at least a portion of the phenolic particles are in the range from 150 micrometers to 2400 micrometers in size.

3. The method according to claim 1, wherein at least a portion of the phenolic particles are in the range from 400 micrometers to 850 micrometers in size.

4. The method according to claim 1, wherein at least a portion of the phenolic particles are in the range from 150 micrometers to 1000 micrometers in size.

5. The method according to claim 1, wherein at least a majority by weight of the phenolic particles are in the range from 150 micrometers to 2400 micrometers in size.

6. The method according to claim 1, wherein at least a majority by weight of the phenolic particles are in the range from 400 micrometers to 850 micrometers in size.

7. The method according to claim 1, wherein at least a majority by weight of the phenolic particles are in the range from 150 micrometers to 1000 micrometers in size.

8. The method according to claim 1, wherein at least 75 percent by weight of the phenolic particles are in the range from 150 micrometers to 2400 micrometers in size.

9. The method according to claim 1, wherein at least 75 percent by weight of the phenolic particles are in the range from 400 micrometers to 850 micrometers in size.

10. The method according to claim 1, wherein at least 75 percent by weight of the phenolic particles are in the range from 150 micrometers to 1000 micrometers in size.

11. The method according to claim 1, wherein the phenolic particles comprise filler.

12. The method according to claim 1, wherein the substrate is aluminum.

13. The method according to claim 1, wherein the substrate is cast iron.

14. A method of removing gasket material from a substrate, the method comprising:

providing a power driven abrasive device comprising a rotatable shaft having an abrasive disc having a work surface attached thereto, the abrasive article comprising:

a scrim having a first major surface;

a nonwoven, three dimensional fibrous web having first and second major surfaces, wherein the first major surface of the fibrous web is needle tacked to the first major surface of the scrim;

an abrasive layer having work surface secured to the second major surface of the fibrous web, the abrasive layer comprised of binder and a plurality of phenolic particles, wherein the phenolic particles at the work surface are free of abrasive particles larger than 6 micrometers;

energizing the power driven abrasive device such that the rotatable shaft rotates; and frictionally engaging at least a portion of the work surface of the rotating abrasive disc with the gasket material to be removed such that at least a portion of the gasket material is removed.

15. The method according to claim 14 wherein at least a portion of the phenolic particles are in the range from 150 micrometers to 2400 micrometers in size.

16. The method according to claim 14, wherein at least a portion of the phenolic particles are in the range from 400 micrometers to 850 micrometers in size.

17. The method according to claim 14, wherein at least a portion of the phenolic particles are in the range from 150 micrometers to 1000 micrometers in size.

18. The method according to claim 14, wherein at least a majority by weight of the phenolic particles are in the range from 150 micrometers to 2400 micrometers in size.

19. The method according to claim 14, wherein at least a majority by weight of the phenolic particles are in the range from 400 micrometers to 850 micrometers in size.

20. The method according to claim 14, wherein at least a majority by weight of the phenolic particles are in the range from 150 micrometers to 1000 micrometers in size.

21. The method according to claim 14, wherein at least 75 percent by weight of the phenolic particles are in the range from 150 micrometers to 2400 micrometers in size.

22. The method according to claim 14, wherein at least 75 percent by weight of the phenolic particles are in the range from 400 micrometers to 850 micrometers in size.

23. The method according to claim 14, wherein at least 75 percent by weight of the phenolic particles are in the range from 150 micrometers to 1000 micrometers in size.

24. The method according to claim 14, wherein the phenolic particles comprise filler.

25. The method according to claim 14, wherein the substrate is aluminum.

26. The method according to claim 14, wherein the substrate is cast iron.

27. The method according to claim 14, wherein the power driven abrasive device is an electric motor driven abrasive device.

28. The method according to claim 14, wherein the power driven abrasive device is a right angle electric motor driven abrasive device.

29. The method according to claim 14, wherein the power driven abrasive device is an air driven abrasive device.

* * * * *

UNITED STATES PATENT AND TRADEMARK OFFICE

CERTIFICATE OF CORRECTION

PATENT NO. : 6,786,801 B2 
DATED : September 7, 2004
INVENTOR(S) : Mann, Lawrence J.

It is certified that error appears in the above-identified patent and that said Letters Patent is hereby corrected as shown below:

Title page,
Item [56], References Cited, OTHER PUBLICATIONS,
"Copending" reference, after "09/833942" insert -- (Attorney Docket No. 56319US002) --.
"Standard Abrasives" reference, delete "htp" and insert -- http --.

Column 6,
Line 28, delete "dimethylacrylarnide" and insert -- dimethylacrylamide --.

Column 11,
Line 3, after "staple" delete "2".

Column 12,
Lines 25-26, delete "as received" and insert -- as-received --.

Signed and Sealed this

Twenty-sixth Day of July, 2005

JON W. DUDAS
*Director of the United States Patent and Trademark Office*